US007080956B2

(12) United States Patent
Neden et al.

(10) Patent No.: US 7,080,956 B2
(45) Date of Patent: Jul. 25, 2006

(54) OPEN BOTTOM BOX CULVERT

(75) Inventors: Ronald J. Neden, Armstrong (CA); Calvin D. VanBuskirk, Salmon Arm (CA)

(73) Assignee: Terratech Consulting Ltd., Salmon Arm (CA)

( * ) Notice: Subject to any disclaimer, the term of this patent is extended or adjusted under 35 U.S.C. 154(b) by 0 days.

(21) Appl. No.: 11/266,363

(22) Filed: Nov. 4, 2005

(65) Prior Publication Data

US 2006/0115330 A1 Jun. 1, 2006

Related U.S. Application Data

(60) Provisional application No. 60/631,167, filed on Nov. 29, 2004.

(51) Int. Cl.
*E01F 5/00* (2006.01)

(52) U.S. Cl. ..... 405/124; 405/125

(58) Field of Classification Search ..... 405/46, 405/49, 124–126
See application file for complete search history.

(56) References Cited

U.S. PATENT DOCUMENTS 4,211,504 A * 7/1980 Sivachenko ..... 405/124
4,390,306 A * 6/1983 Fisher ..... 405/124
4,563,107 A * 1/1986 Peterson ..... 405/124
4,706,319 A 11/1987 Sivachenko et al.
4,869,294 A * 9/1989 Matiere ..... 405/126
6,874,974 B1 * 4/2005 VanBuskirk et al. ..... 405/124

* cited by examiner

*Primary Examiner*—Frederick L. Lagman
(74) *Attorney, Agent, or Firm*—Oyen Wiggs Green & Mutala LLP

(57) ABSTRACT

This invention relates to a novel design of an open bottom box culvert which can be used to enable roads, highways and other infrastructure to cross streams without infringing on the wetted perimeter of a stream or interrupting the stream gradient. More particularly, this invention pertains to an innovative use of mineral soil (clay, silt, sand, gravel, cobbles, boulders, broken rock, ice or mixtures of any or all of the foregoing), concrete or wood abutments and metal such as steel, and in some cases geosynthetics, to construct an open bottom box culvert structure which can be erected over a stream or creek and enable vehicular loads and other infrastructure to cross the stream or creek. An open bottom box culvert comprising a pair of abutments spatially positioned from each other, at least one corrugated steel plate spanning the top portions of the two spatially positioned abutments, at least one shear connector positioned above the corrugated steel plate and connected thereto, and compacted soil disposed above and on each exterior side of the pair of abutments, the corrugated steel plate and at least one shear connector.

12 Claims, 4 Drawing Sheets

OPEN BOTTOM BOX CULVERT

This application claims benefit of U.S. provisional application No. 60/631,167, filed Nov. 29, 2004.

FIELD OF THE INVENTION

This invention relates to a novel design of an open bottom box culvert which can be used to enable roads, highways and other infrastructure to cross streams without infringing on the wetted perimeter of a stream or interrupting the stream gradient. More particularly, this invention pertains to an innovative use of mineral soil (clay, silt, sand, gravel, cobbles, boulders, broken rock, ice or mixtures of any or all of the foregoing), concrete or wood abutments and metal such as steel, and in some cases geosynthetics, to construct an open bottom box culvert structure which can be erected over a stream or creek and enable vehicular loads and other infrastructure to cross the stream or creek.

BACKGROUND OF THE INVENTION

Bridges, culverts, overpasses, and the like, are traditionally constructed of expensive and environmentally incompatible steel structures, reinforced concrete structures, plastic structures and the like. Specifically, culverts used in road construction whenever a stream or creek needs to pass under the road, have been constructed of wood, concrete, corrugated steel or corrugated plastic pipes. These culverts corrode or deteriorate over time and must be replaced. Removal can result in damage to the stream or introduction of sediment to the stream, which is harmful to life in the stream. Costly mitigation techniques are required to prevent or limit the extent of damage and sedimentation.

Corrugated metal culverts and corrugated plastic culverts are subjected over time to freeze/thaw cycles, water erosion and dynamic vehicle loads. These actions can cause the soil compacted around the steel or plastic culverts to become loose and erode away, thereby leaving an uneven load distribution on the culvert, which accelerates deterioration. At some point, the uneven load distribution and soil erosion can be sufficient to cause the culvert to collapse. The culvert must then be replaced. However, simple replacement is no longer an option. The Canadian Department of Fisheries and Oceans has in recent years passed regulations that require that the culverts must be replaced with open bottom structures that cause minimal damage to streams and do not interfere with fish migration and spawning, which includes salmon.

U.S. Pat. No. 4,706,319, Sivachenko et al., 1988, discloses a more or less relevant stream crossing construction which is primarily intended for long spans (bridges) and uses concrete as a compressive component of the structure.

SUMMARY OF INVENTION

This invention relates to an innovative open bottom box culvert which can be constructed of compacted soil and/or ice in combination with steel, concrete and other suitable materials. The box culvert, according to the invention, utilizes an innovative combination of mineral soil (clay, silt, sand, gravel, cobbles, boulders, broken rock or mixtures of any or all of the preceding), and/or ice, wood, steel, concrete abutments, and steel plate to construct the open bottom culvert. In some instances, when required, the invention uses alternating layers of compacted soil and reinforcement consisting of geosynthetics, plastic, metal and/or the like, to create an open bottom culvert that can support both the dead load of the open bottom culvert structure and any live load that is imposed on the structure.

The invention is directed to an open bottom box culvert comprising: (a) a pair of abutments spatially positioned from each other; (b) a corrugated steel plate spanning the top portions of the two spatially positioned abutments; (c) one or more shear connectors positioned above the corrugated steel plate and connected thereto; and (d) compacted soil and/or ice disposed above and on each exterior side of the pair of abutments, the corrugated steel plate and at least one shear connector.

The culvert can include a pair of elastomeric bearing pads disposed between the top portions of the pair of abutments and the adjacent areas of the corrugated steel plate. The corrugations in the corrugated steel plate can have a parallel tapered rectangular profile and one or more spatially disposed parallel shear connectors can be positioned on the corrugated steel plate laterally to the directions of the parallel tapered rectangular profiles of the corrugated steel plate. The plurality of shear connectors can be elongated and have an "L" "T", "I", "U", "O" cross-section, or the like.

A non-corrugated steel plate may be fastened to the top and/or bottom of the corrugated steel plate when required to accommodate heavier usage or reusage.

The corrugated steel plate can have a sinusoidal profile. The plurality of shear connectors can be connected to the corrugated steel plate by nuts and bolts or other suitable fastening means. The compacted soil can be reinforced by geosynthetic material such as plastic, metal, or combinations thereof, which can be arranged in layers with compacted soil between each layer.

BRIEF DESCRIPTION OF DRAWINGS

In drawings which illustrate specific embodiments of the invention, but which should not be construed as restricting the spirit or scope of the invention in any way.

DETAILED DESCRIPTION OF THE INVENTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

In appropriate locations and for winter use, the box culvert can be constructed using ice or a mixture of ice and soil in place of the soil fill. For higher loads and rougher usage or re-usage a non-corrugated steel plate can be attached to the top and/or bottom of the corrugated steel.

Figure 1:
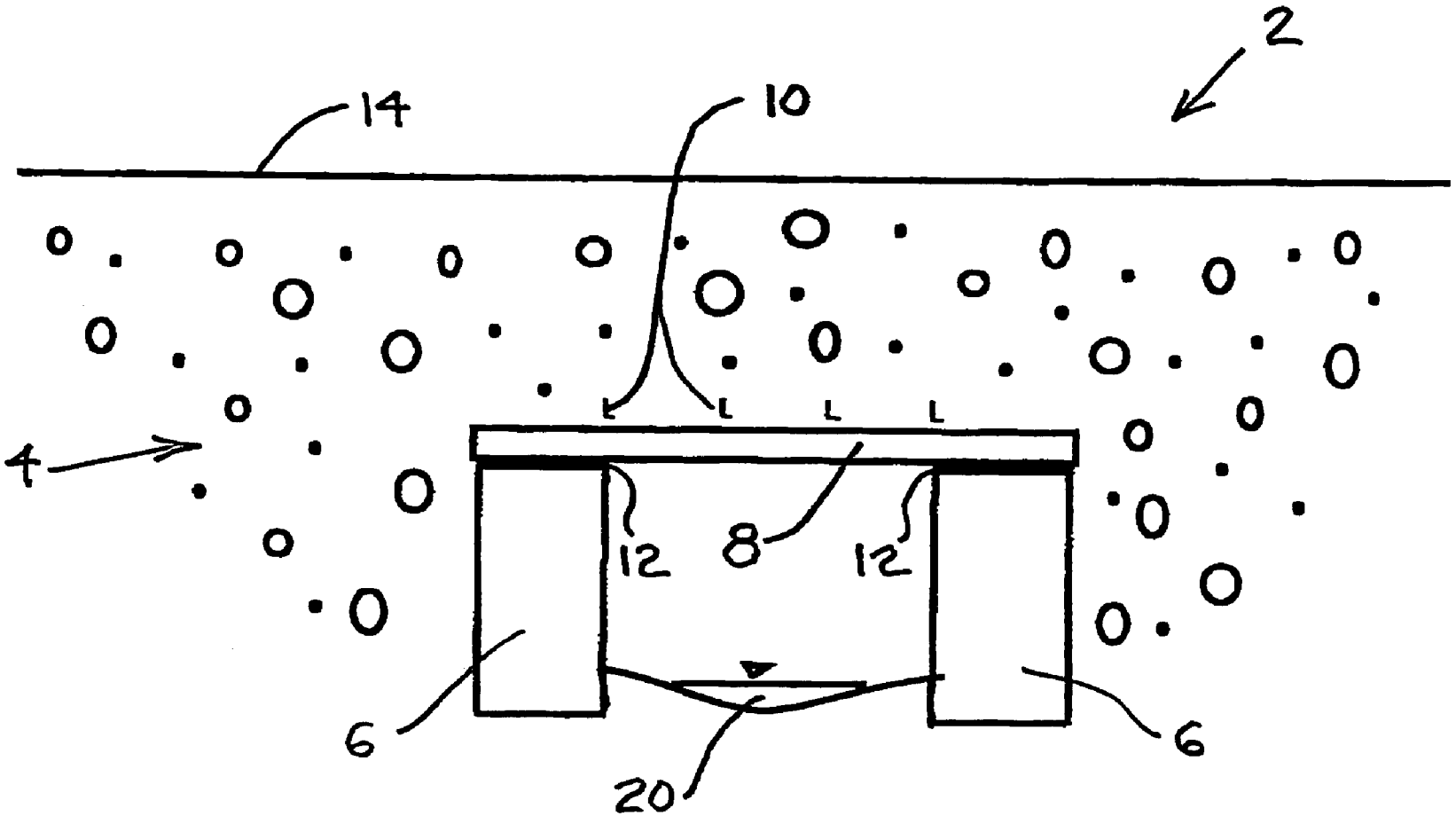
FIG. 1 illustrates a schematic front view of the open bottom box culvert according to the invention.

Referring to the drawings, FIG. 1 illustrates a schematic front view of an open bottom soil and steel box culvert according to the invention. As seen in FIG. 1, the overall open bottom box culvert 2 is constructed of a pair of parallel vertical abutments 6, which at the tops thereof are spanned by a corrugated steel plate 8, preferably galvanized for corrosion protection. Shear connectors 10, disposed laterally to the grooves in the corrugated steel plate 8, are disposed in parallel series on the top of the corrugated steel plate 8. A pair of elastomeric or extruded polystyrene bearing pads 12 are located at the tops of each of the parallel vertical abutments 6 below the adjacent bearing portions of the corrugated steel plate 8. A stream 20 flows between the pair of parallel abutments 6 and below the corrugated steel plate 8. Compacted soil and/or ice fill 4 is distributed over and on each side of the plate 8, connectors 10 and two abutments 6. A roadway 14 can then be constructed across the top of the overall open bottom box culvert.

Figure 2:
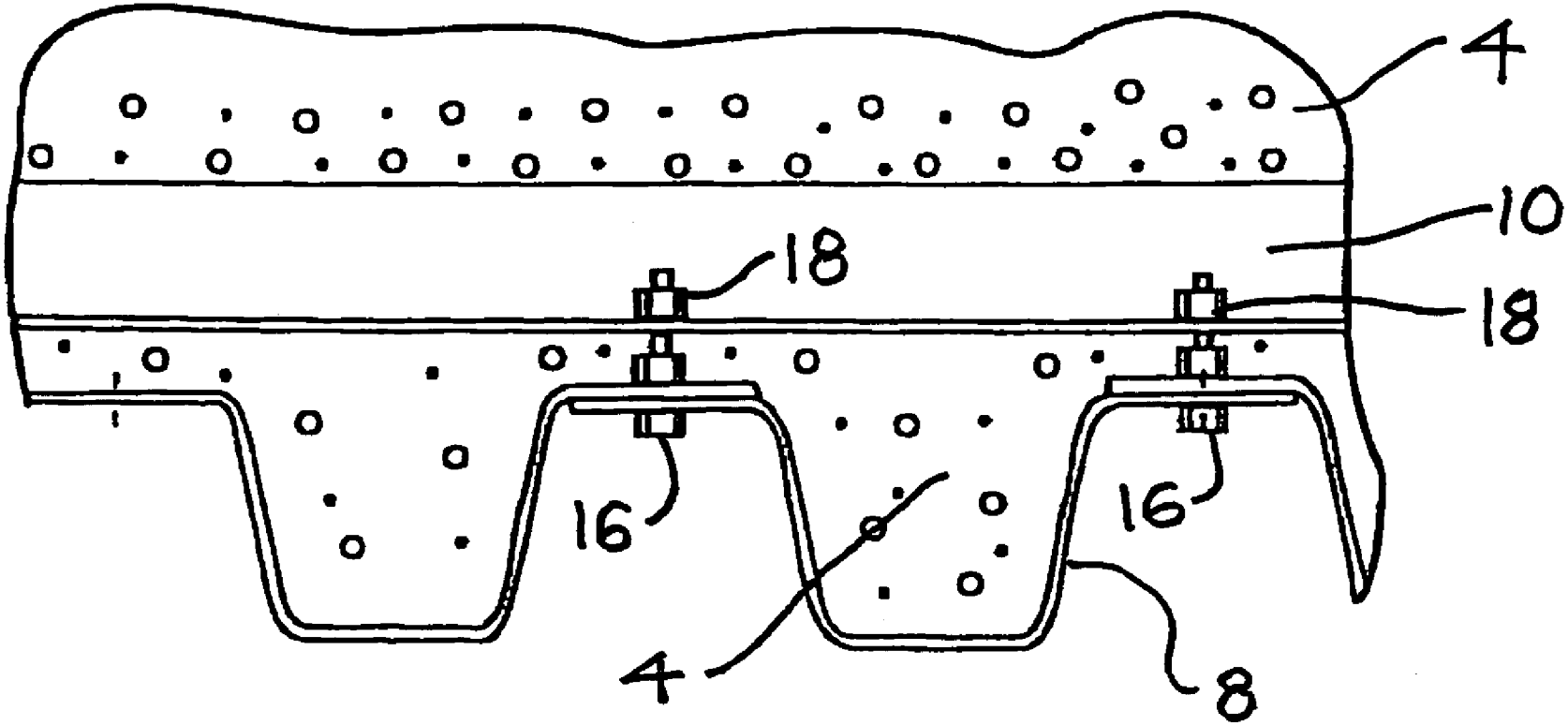
FIG. 2 illustrates a detailed cross-section view of the combination of compacted soil and/or ice fill, shear connector and corrugated steel plate according to the invention.

FIG. 2 illustrates a detailed cross-section view of the combination of compacted soil and/or ice fill, shear connector and corrugated steel plate according to the invention. As seen in FIG. 2, the shear connector 10 (only one is shown) is disposed laterally to the grooves that are part of the corrugated steel plate 8. Adjacent sections of corrugated steel plate 8 are secured together by bolts 16. The compacted fill and/or ice 4 is then placed below the level of the shear connector 10 and portions thereof rest in the upper grooves in the corrugated plate 8. The lateral shear connector 10 (and other shear connectors which are not shown) are fastened to bolts 16 and the corrugated steel plate 8 by nuts 18. The compacted soil fill and/or ice 4 is then disposed above the shear connector 10. The cross-linking structure provided by the corrugated portions of the corrugated steel plate 8 and the lateral extending series of parallel shear connectors 10, coupled with the bolts 16 and nuts 18, provides a strong relatively inexpensive composite load bearing structure.

Figure 3:
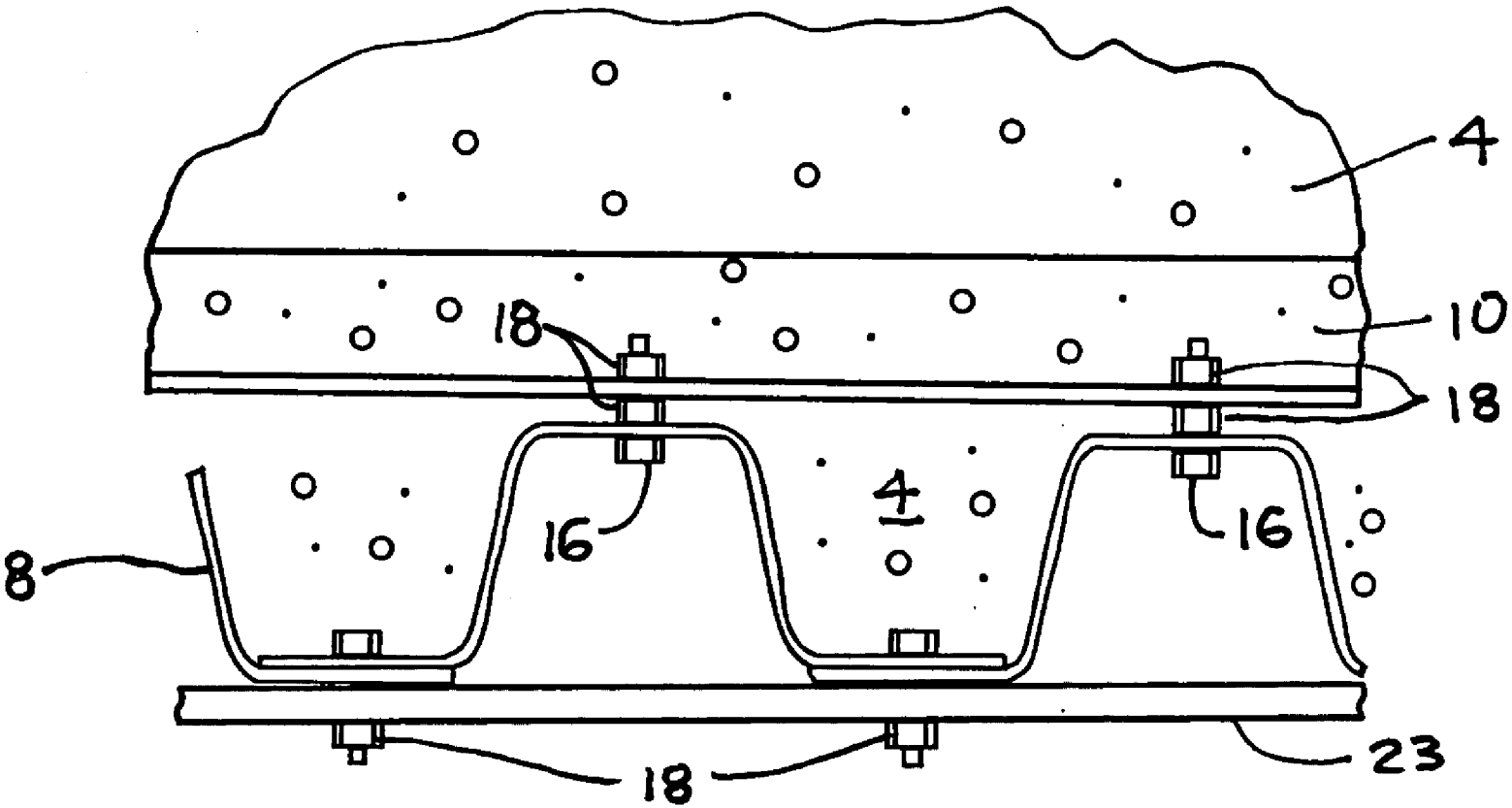
FIG. 3 illustrates a detailed cross-section view of the compacted soil and/or ice fill, shear connector, corrugated steel plate and non-corrugated steel plate reinforcement according to the invention.

FIG. 3 illustrates a detailed cross-section view of combination of compacted soil and/or ice fill and corrugated steel plate and a non-corrugated steel plate reinforcement. In this option, a non-corrugated steel plate 23 is fastened to the top and/or bottom of the corrugated steel plate 8 by bolt 16. In FIG. 3, the plate 23 is shown fastened to the bottom of the corrugated steel plate 8. However, it will be understood that the steel plate 23 can be fastened to the top of the corrugated steel plate 8, or two steel plates, one fastened to the top and one fastened to the bottom of the corrugated steel plate 8, can be used if conditions require it.

Figure 4:
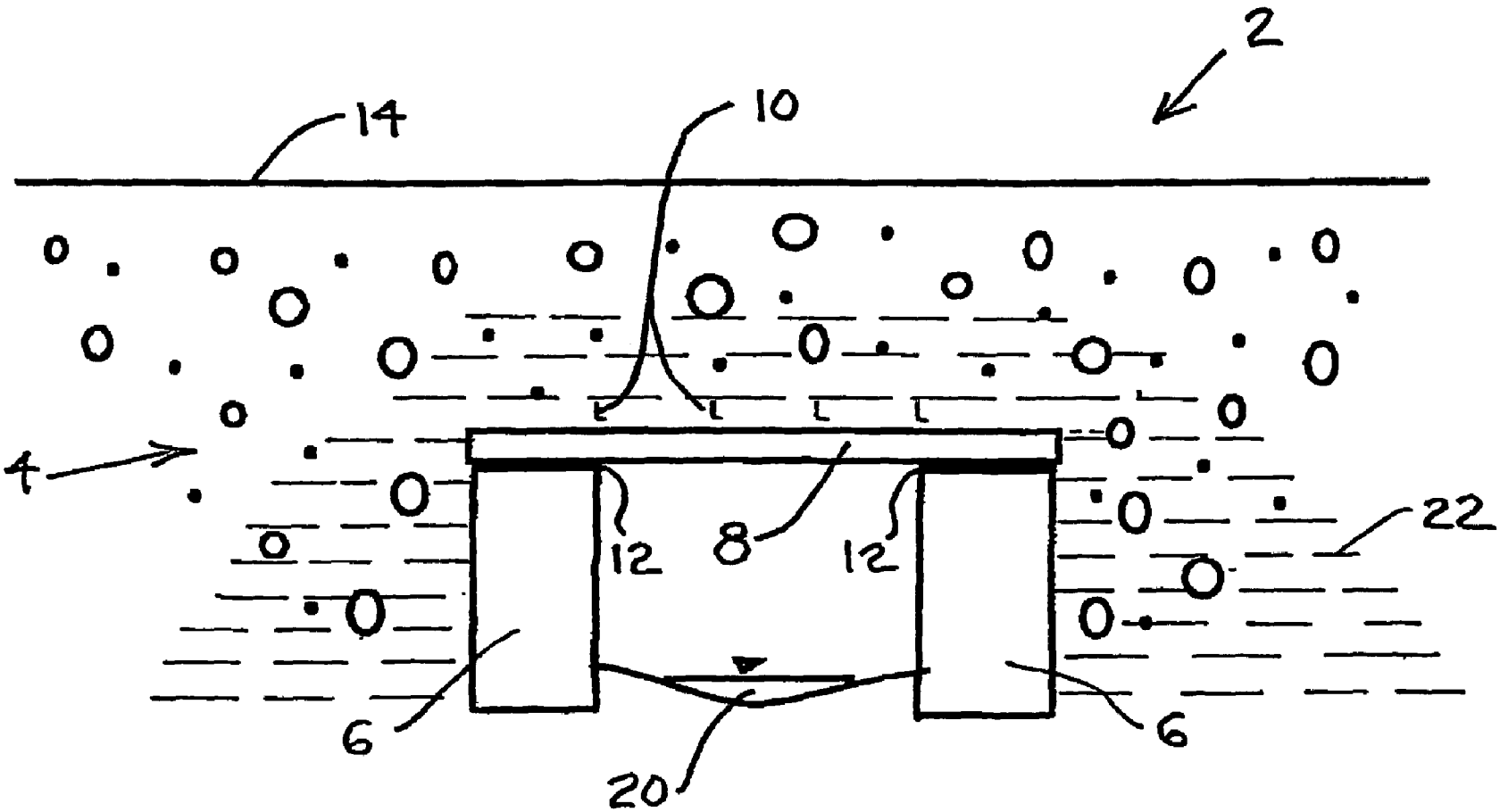
FIG. 4 illustrates a schematic front view of the open bottom box culvert with the surrounding compacted soil reinforced with layers of geosynthetic material.

FIG. 4 illustrates a schematic front view of the open bottom soil and steel box culvert with the compacted soil reinforced with layers of geosynthetic material. As can be seen, the layers of geosynthetic material 22 alternate with layers of compacted soil 4.

Shear stresses between the compacted soil and/or ice 4 and the corrugated steel plate 8 are resisted by the shear connectors 10 which are embedded in the compacted soil and/or ice 4 and are secured to the corrugated steel plate 8. The corrugated steel plate 8 may have a sinusoidal profile, tapered rectangular profile or any other suitable profile for strength.

The invention is typically constructed as a short span (up to 6 m in length), open bottom structure which allows roads, highways and other infrastructure to cross streams without infringing on the wetted perimeter of the stream or interrupting the stream gradient. The invention can also be used in other situations where short span, open bottom, load carrying structures are required.

The open bottom box culvert according to the invention has the following constructional benefits. The corrugated steel plates 8 provide tensile resistance to the bending moments imposed by both dead and live loads. The compacted soil and/or ice 4 provides compressive resistance to such bending moments. When reinforced with layers of geosynthetics 22, the compressive strength of the compacted soil and/or ice is increased.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A trapezoidal open bottom box culvert comprising:

(a) a pair of vertical elongated abutments spatially positioned from each other;

(b) at least one horizontal linear corrugated steel plate spanning and resting on the top portions of the two spatially positioned abutments without being secured to the tops of the respective abutments;

(c) at least one shear connector positioned above the linear corrugated steel plate and connected thereto, the at least one shear connector extending laterally to the corrugations in the corrugated steel plate; and (d) compacted soil disposed above and on each exterior side of the pair of abutments, the corrugated steel plate and at least one shear connector, the compacted soil engaging the at least one shear connector and stiffening the corrugated steel plate.

2. A culvert as claimed in claim 1 wherein the compacted soil can be compacted soil and ice, or ice.

3. A culvert as claimed in claim 1 including a pair of elastomeric bearing pads disposed between the top portions of the pair of abutments and the adjacent areas of the corrugated steel plate.

4. A culvert as claimed in claim 3 wherein the bearing pads are extruded polystyrene.

5. A culvert as claimed in claim 1 wherein the corrugations in the corrugated steel plate have a parallel tapered rectangular profile and at least one spatially disposed parallel shear connector is positioned on the corrugated steel plate laterally to the directions of the parallel tapered rectangular profiles of the corrugated steel plate.

6. A culvert as claimed in claim 5 wherein there is a plurality of shear connectors which are elongated and have an "L" "T", "I", "U" or "O" cross-section.

7. A culvert as claimed in claim 1 wherein the corrugated steel plate has a sinusoidal profile.

8. A culvert as claimed in claim 6 wherein the plurality of shear connectors are connected to the corrugated steel plate by nuts and bolts.

9. A culvert as claimed in claim 6 wherein the plurality of shear connectors are connected to the corrugated steel plate by fasteners.

10. A culvert as claimed in claim 1 wherein the compacted soil is reinforced by geosynthetic material which is arranged in layers with compacted soil between each layer.

11. A culvert as claimed in claim 2 wherein the compacted soil and ice or ice is reinforced by geosynthetic material which is arranged in layers with compacted soil and ice or ice between each layer.

12. A culvert as claimed in claim 1 wherein a steel plate is attached to the top or the bottom or both the top and bottom of the corrugated steel plate.

* * * * *